US008102106B2

(12) United States Patent
Katsuraya et al.

(10) Patent No.: US 8,102,106 B2
(45) Date of Patent: Jan. 24, 2012

(54) SPARK PLUG AND METHOD OF MANUFACTURING THE SAME

(75) Inventors: Kohei Katsuraya, Aichi (JP); Katsutoshi Nakayama, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 12/998,324

(22) PCT Filed: Oct. 13, 2009

(86) PCT No.: PCT/JP2009/005325

§ 371 (c)(1), (2), (4) Date: Apr. 8, 2011

(87) PCT Pub. No.: WO2010/044249

PCT Pub. Date: Apr. 22, 2010

(65) Prior Publication Data

US 2011/0193469 A1 Aug. 11, 2011

(30) Foreign Application Priority Data

Oct. 16, 2008 (JP) ..... 2008-267884

(51) Int. Cl.
*H01T 1/22* (2006.01)
*H01T 1/00* (2006.01)
*H01T 21/00* (2006.01)

(52) U.S. Cl. ..... 313/141; 313/142; 313/143; 445/7

(58) Field of Classification Search ..... 313/118–145; 445/7

See application file for complete search history.

(56) References Cited

U.S. PATENT DOCUMENTS

| | | | | |
|---|---|---|---|---|
| 3,970,885 | A * | 7/1976 | Kasima | 313/141 |
| 4,331,899 | A * | 5/1982 | Nishida et al. | 313/141 |
| 5,998,912 | A | 12/1999 | Schwab | 313/118 |
| 2006/0220511 | A1 | 10/2006 | Hanashi et al. | 313/141 |

FOREIGN PATENT DOCUMENTS

| | | | |
|---|---|---|---|
| DE | 3820552 | A1 | 12/1989 |
| JP | 55-121290 | | 9/1980 |
| JP | 01264187 | A * | 10/1989 |
| JP | 2006-286469 | | 10/2006 |
| JP | WO2009/017187 | | 2/2009 |
| JP | 2009-054574 | | 3/2009 |
| JP | 2009-054579 | | 3/2009 |

OTHER PUBLICATIONS

International Search Report for International Application No. PCT/JP2009/005325, Jan. 19, 2010.

Nishioka et al., "Super Ignition Spark Plug with Wear Resistive Electrode," SAE International™, SAE Technical Paper Series, Reprinted From: Advanced Concepts, 2008, Apr. 14-17, 2008.

* cited by examiner

*Primary Examiner* — Mariceli Santiago
(74) *Attorney, Agent, or Firm* — Kusner & Jaffe

(57) ABSTRACT

A spark plug having a ground electrode that includes a press-formed recess portion comprised of a first portion with which a working pin has come into contact, and a second portion with which the working pin has not come into contact. A relation B1/B2≧0.05 is satisfied, where B1 represents the depth of the second portion, and B2 represents the depth of the press-formed recess portion.

6 Claims, 15 Drawing Sheets

Y-Y CROSS SECTION

X-X CROSS SECTION

Y-Y CROSS SECTION (A)

| RATIO (B1/B2) BETWEEN DEPTH B1 OF WORKING-PIN-UNCONTACTED SECOND PORTION AND DEPTH B2 OF PRESS-FORMED RECESS PORTION | 0.02 | 0.05 | 0.1 | 0.2 | 0.5 |
|---|---|---|---|---|---|
| BITING OCCURRENCE RATE (%) | 40 | 0 | 0 | 0 | 0 |

(B)

(A)

| RATIO (B1/B2) BETWEEN DEPTH B1 OF WORKING-PIN-UNCONTACTED SECOND PORTION AND DEPTH B2 OF PRESS-FORMED RECESS PORTION | 0.02 | 0.05 | 0.1 |
|---|---|---|---|
| GENERATION OF CRACK | GENERATED | NOT GENERATED | NOT GENERATED |

(B)

(A)

| DIFFERENCE (ϕC-ϕD) BETWEEN DIAMETER ϕC OF BOUNDARY PLANE BETWEEN FIRST AND SECOND PORTIONS AND DIAMETER ϕD OF BOTTOM SURFACE OF PRESS-FORMED RECESS PORTION (mm) | -0.2 | -0.1 | 0 | 0.1 | 0.2 | 0.3 | 0.4 | 0.5 |
|---|---|---|---|---|---|---|---|---|
| RATIO (C/D) BETWEEN AREA C OF BOUNDARY PLANE BETWEEN FIRST AND SECOND PORTIONS AND AREA D OF BOTTOM SURFACE OF PRESS-FORMED RECESS PORTION | 0.78 | 0.89 | 1.00 | 1.12 | 1.25 | 1.38 | 1.53 | 1.67 |
| BITING OCCURRENCE RATE (%) | 70 | 0 | 0 | 0 | 0 | 0 | 0 | 0 |
| DEFECTIVE PRODUCT RATE (%) | 0 | 0 | 0 | 0 | 0 | 0 | 0 | 80 |

(B)

(C)

(A)

| ANGLE E BETWEEN STRAIGHT LINE E1 AND STRAIGHT LINE E2 (°) | 0 | 2 | 4 | 5 | 6 | 7 |
|---|---|---|---|---|---|---|
| BITING OCCURRENCE RATE (%) | 0 | 0 | 0 | 0 | 80 | 100 |

(B)

(A)

| RATIO (F1/F2) BETWEEN LENGTH F1 OF FLAT SURFACE FROM ROOT AND DISTANCE F2 BETWEEN ROOT AND SIDE END SURFACE | 0 | 0.2 | 0.3 | 0.4 | 0.6 | 1.0 |
|---|---|---|---|---|---|---|
| CRACK GENERATION RATE (%) | 70 | 60 | 30 | 0 | 0 | 0 |

(B)

SPARK PLUG AND METHOD OF MANUFACTURING THE SAME

FIELD OF THE INVENTION

The present invention relates to a spark plug (ignition plug) that ignites fuel within an internal combustion engine through generation of electric spark, and more particularly to a ground electrode of such a spark plug.

BACKGROUND OF THE INVENTION

Conventionally, there has been proposed a technique of forming a projecting portion on a ground electrode of a spark plug through press working, in order to improve ignition performance of the spark without use of a noble metal chip on the ground electrode. Japanese Patent Application Laid-Open (kokai) No. 2006-286469 (Patent Document 1) discloses a technique of forming a projecting portion of a ground electrode by means of "press forging," which is one type of press working. Shin Nishioka et al., "Super Ignition Spark Plug with Wear Resistive Electrode", SAE TECHNICAL PAPER SERIES 2008-01-0092, published in April 2008 (Non-patent Document 1) discloses a technique of forming a projecting portion on a ground electrode by means of "half punching," which is another type of press working. Specifically, a ground electrode is pressed from the upper side thereof with a working pin so as to form a recess portion, to thereby form a projecting portion on the side opposite the recess portion.

SUMMARY OF THE INVENTION

Problems to be Solved by the Invention

However, conventionally, a sufficient degree of consideration has not been given to formation of a projecting portion on a ground electrode through press working. For example, in the case of half punching, when a ground electrode is pressed with a working pin so as to form a recess portion, the working pin bites against the ground electrode, and chipping or the like occurs when the working pin is withdrawn, whereby the service life of a tool, such as the working pin, may be shortened. Moreover, as a result of press working with the working pin or withdrawal of the working pin, deformation of the ground electrode may exceed a plastic region. In such a case, cracking or chipping may occur in the ground electrode with a resultant deterioration in durability of the ground electrode.

In view of the above-described problems, a first object of the present invention is to mitigate biting of a working pin against a ground electrode at the time of formation of a projecting portion on the ground electrode through press working. A second object of the present invention is to prevent cracking and chipping of the ground electrode to thereby improve durability of the ground electrode.

It should be understood that the terms "bites," "biting" and "bit," as used herein, refer to the catch, hold or grip that the working pin has on the ground electrode when forming the projecting portion on the ground electrode.

Means for Solving the Problems

The present invention has been accomplished so as to solve at least a portion of the above-described problems, and can be realized in the following embodiments or application examples.

APPLICATION EXAMPLE 1

A spark plug of the application example 1 comprises a rod-shaped center electrode; an insulator which holds the outer circumference of the center electrode; a metallic shell which holds the outer circumference of the insulator; and a ground electrode joined to the metallic shell and forming a spark gap between the ground electrode and the center electrode, the ground electrode having a projecting portion which is formed through half punching performed by use of a working pin and which faces the center electrode, and a press-formed recess portion formed on a back surface of the projecting portion as a result of formation of the projecting portion through the half punching, wherein the press-formed recess portion is composed of a first portion with which the working pin has come into contact, and a second portion with which the working pin has not come into contact; and a relation $B1/B2 \geqq 0.05$ is satisfied, where B1 represents a depth of the second portion, and B2 represents a depth of the press-formed recess portion.

According to the spark plug of the application example 1, the ratio of the depth of the second portion with which the working pin has not come into contact, to the depth of the press-formed recess portion is made equal to or greater than a predetermined value. Therefore, the ratio of the depth of a portion of the press-formed recess portion with which the working pin comes into contact, to the depth of the press-formed recess portion can be decreased. As a result, the frictional resistance between the working pin and the press-formed recess portion decreases, whereby biting of the working pin against the ground electrode can be mitigated.

APPLICATION EXAMPLE 2

In the spark plug according to the application example 1, a relation $0.83 \leqq C/D \leqq 1.60$ may be satisfied, where C represents an area of a boundary plane, which is a surface selected from surfaces parallel to a bottom surface of the press-formed recess portion and surrounded by the side surface of the press-formed recess portion, the selected surface containing the boundary between the first portion and the second portion to the greatest extent; and D represents an area of the bottom surface of the press-formed recess portion.

According to the spark plug of the application example 2, biting of the working pin against the ground electrode can be mitigated, and, at the same time, the projecting portion can be formed into a desired target shape.

APPLICATION EXAMPLE 3

In the spark plug according to the application example 1 or 2, the ground electrode has, at its one end, a joint portion joined to the metallic shell, and, at its other end, a distal end portion having a distal end surface; the distal end surface is approximately parallel to an axial direction of the center electrode; and, as viewed on a cross section of the ground electrode parallel to the axial direction of the center electrode, passing through the centroid of the projecting portion, and perpendicular to the distal end surface, an angle E which satisfies a relation $0° \leqq E \leqq 5°$ may be formed between a straight line E1 and a straight line E2, the straight line E1 passing through a distal end portion of the ground electrode on the side facing the center electrode and a distal-end-side root portion of the ground electrode, which is a portion of a root of the projecting portion located on the side toward the distal end of the ground electrode, and the straight line E2 passing through the distal-end-side root portion and a proximal-end-side root portion of the ground electrode, which is a portion of the root of the projecting portion located on the side toward the proximal end of the ground electrode.

According to the spark plug of the application example 3, through suppression of deformation of the ground electrode on the distal end side in relation to the projecting portion, biting of the working pin against the ground electrode can be mitigated.

APPLICATION EXAMPLE 4

In the spark plug according to any of the application examples 1 to 3, a ratio F1/F2 may satisfy a relation $0.4 \leqq F1/F2 \leqq 1$, where F1 represents a length of a flat surface extending from the root of the projecting portion to a side end of the ground electrode, and F2 represents a distance between the root and the side end of the ground electrode.

According to the spark plug of the application example 4, through suppression of deformation around the projecting portion, generation of crack, in particular, in the projecting portion or its surrounding area can be suppressed. As a result, durability of the ground electrode can be improved.

APPLICATION EXAMPLE 5

In the spark plug according to any of the application examples 1 to 4, the projecting portion may have a height A which satisfies a relation $0.4\ \text{mm} \leqq A \leqq 1.0\ \text{mm}$.

According to the spark plug of the application example 5, since the height of the projecting portion is not less than 0.4 mm, the spark plug can exhibit a stable ignition performance when it is attached to an internal combustion engine so as to ignite fuel. Furthermore, since the height of the projecting portion is not greater than 1.0 mm, durability of the ground electrode can be improved.

The mode of the present invention is not limited to a spark plug and a method of manufacturing the same. For example, the present invention can be applied to various modes, such as a ground electrode of a spark plug and a method of manufacturing the same, and an internal combustion engine equipped with a spark plug. Furthermore, the present invention is not limited to the above-described mode, and can be practiced in various forms without departing from the gist of the present invention.

MODE FOR CARRYING OUT THE INVENTION

Embodiments of the present invention and results of experiments will next be described in the following order.

A. Various Embodiments,

B. Experiment Results, and

C. Modifications.

A. Various Embodiments

Figure 1:
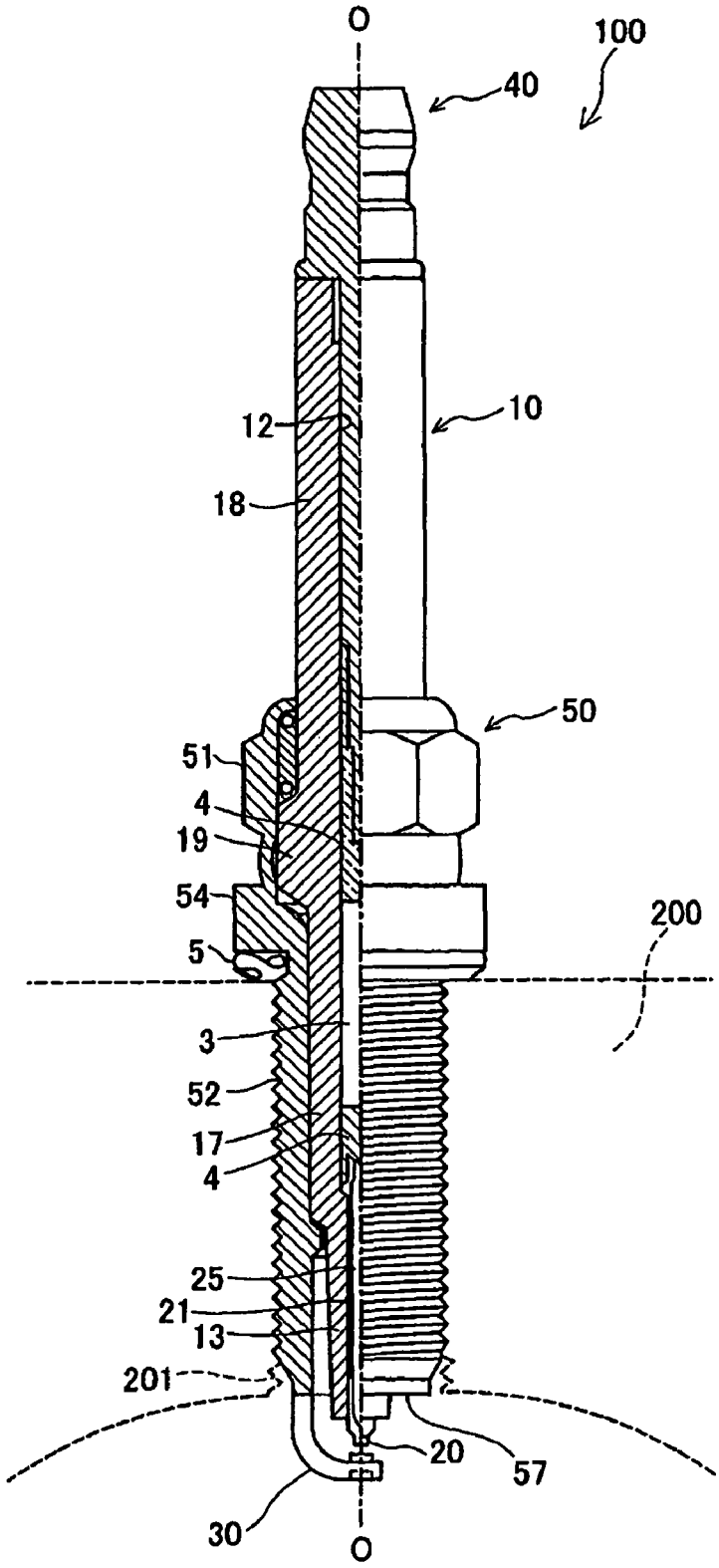
FIG. 1 is an explanatory view mainly showing a partial cross-sectional view of a spark plug.

FIG. 1 is an explanatory view mainly showing a partial cross-sectional view of a spark plug 100. The spark plug 100 includes an insulator 10, a center electrode 20, a ground electrode 30, a metal terminal 40, and a metallic shell 50. The rod-shaped center electrode 20, which projects from one end of the insulator 10, is electrically connected to the metal terminal 40 provided at the other end of the insulator 10, via the interior of the insulator 10. The outer circumference of the center electrode 20 is held by the insulator 10, and the outer circumference of the insulator 10 is held by the metallic shell 50 at a position spaced from the metal terminal 40. The ground electrode 30, which is electrically connected to the metallic shell 50, projects from the metallic shell 50 toward the center electrode 20, and forms, in cooperation with the center electrode 20, a spark gap, which is a clearance for generation of spark. The spark plug 100 is attached via the metallic shell 50 to a threaded mounting hole 201 provided in an engine head 200 of an internal combustion engine (not shown). When a high voltage of 20,000 to 30,000 V is applied to the metal terminal 40, a spark is generated between the center electrode 20 and the ground electrode 30.

The insulator 10 of the spark plug 100 is an insulating member formed through firing of a ceramic material such as alumina. The insulator 10 has a tubular shape, and has an axial hole 12 formed at the center thereof so as to accommodate the center electrode 20 and the metal terminal 40. The insulator 10 has a flange portion 19 formed at the center with respect to the axial direction and having a larger outer diameter. A rear trunk portion 18 for providing insulation between the metal terminal 40 and the metallic shell 50 is formed on a side toward the metal terminal 40 in relation to the flange portion 19. A front trunk portion 17, which is smaller in outer diameter than the rear trunk portion 18, is formed on a side toward the center electrode 20 in relation to the flange portion 19. A leg portion 13, which is smaller in outer diameter than the front trunk portion 17, is formed frontward of the front trunk portion 17. The leg portion 13 is reduced in outer diameter toward the center electrode 20.

The metallic shell 50 of the spark plug 100 is a cylindrical tubular metallic member which surrounds and holds a portion of the insulator 10 extending from the rear trunk portion 18 to the leg portion 13, and, in the present embodiment, is formed of low carbon steel. The metallic shell 50 includes a tool engagement portion 51, a mount screw portion 52, a seal portion 54, and a front end surface 57. A tool (not shown) for mounting the spark plug 100 onto the engine head 200 is engaged with the tool engagement portion 51 of the metallic shell 50. The mount screw portion 52 of the metallic shell 50 has a screw thread to be screw-engaged with the threaded mounting hole 201 of the engine head 200. The seal portion 54 of the metallic shell 50 is annularly formed at the root of the mount screw portion 52, and an annular gasket 5 formed by means of bending a plate member is inserted between the seal portion 54 and the engine head 200. The front end surface 57 of the metallic shell 50 is an annular surface formed at the front end of the mount screw portion 52. The center electrode 20, surrounded by the leg portion 13, projects from the front end surface 57 at the center thereof.

The center electrode 20 of the spark plug 100 is a rod-shaped electrode composed of an electrode base material 21 formed to have a bottomed tubular shape, and a core material 25 having a thermal conductivity higher than that of the electrode base material 21 and embedded in the electrode base material 21. In the present embodiment, the electrode base material 21 is formed of a nickel alloy, such as Inconel (registered trademark), which includes nickel as the main component; and the core material 25 is formed of copper or a copper alloy which includes copper as the main component. The center electrode 20 is inserted into the axial hole 12 of the insulator 10 so that the front end of the electrode base material 21 projects from the axial hole 12 of the insulator 10, and is electrically connected to the metal terminal 40 via a ceramic resistor 3 and seal members 4.

The ground electrode 30 of the spark plug 100 is joined to the front end surface 57 of the metallic shell 50, and bent in a direction intersecting the axis of the center electrode 20 so that the ground electrode 30 faces the front end of the center electrode 20. In the present embodiment, the ground electrode 30 is formed of a nickel alloy, such as Inconel (registered trademark), which includes nickel as the main component.

Figure 2:
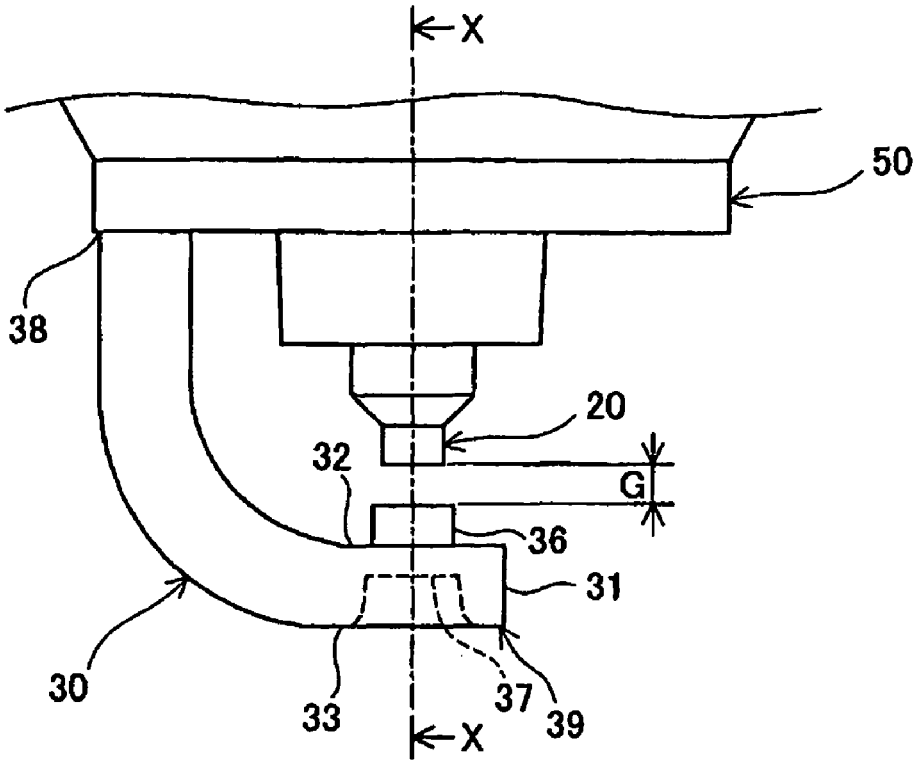
FIG. 2 is an explanatory view mainly showing a specific structure of a ground electrode.

FIG. 2 is an explanatory view mainly showing a specific structure of the ground electrode 30. The ground electrode 30 includes a joint portion 38 joined to the metallic shell 50; a distal end surface 31, which constitutes a distal end portion 39 of the ground electrode 30; an opposing surface 32, which is a surface of the ground electrode 30 in opposition to the center electrode 20; and a back surface 33, which is a surface opposite the opposing surface 32 and facing away from the ground electrode 30. A projecting portion 36 is formed on the opposing surface 32 of the ground electrode 30, by means of half punching, so that the projecting portion 36 projects toward the front end of the center electrode 20. A spark gap G is formed between the projecting portion 36 and the center electrode 20. As a result of formation of the projecting portion 36 through half punching, a recess portion (press-formed recess portion) 37 is formed on the back surface 33 of the ground electrode 30 at the back of the projecting portion 36. The centroids of the projecting portion 36 and the press-formed recess portion 37 are arranged approximately along an extension of the center axis of the center electrode 20. In the present embodiment, the projecting portion 36 is a circular columnar protrusion having a circular cross section; and the press-formed recess portion 37 is a circular columnar or an approximately circular columnar depression having a circular cross section.

Figure 3:
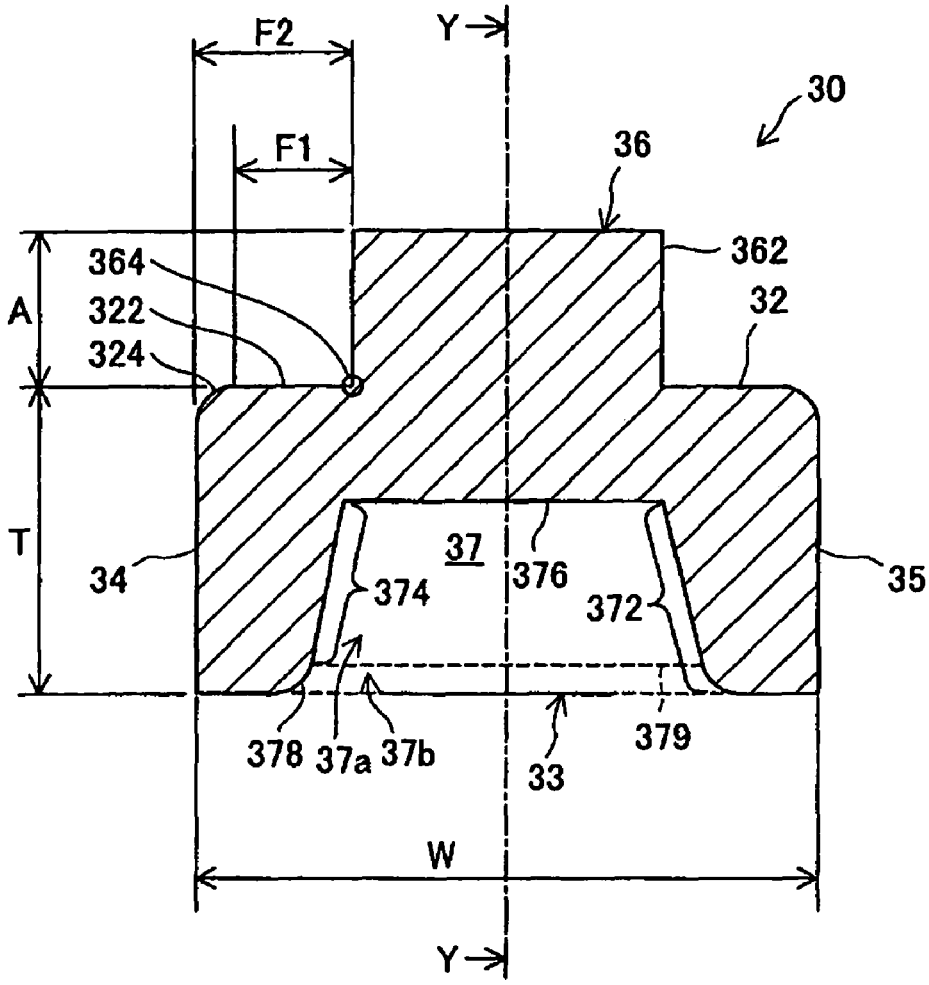
FIG. 3 is an enlarged partial cross-sectional view of the ground electrode taken along line X-X in FIG. 2.
Figure 4:
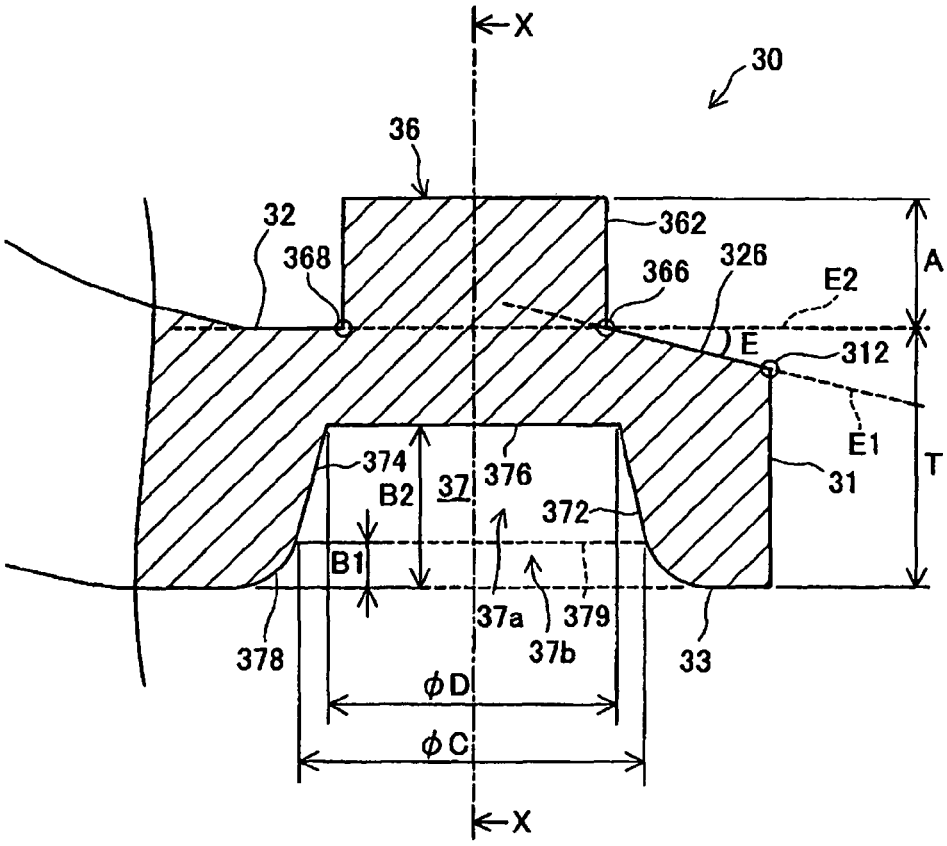
FIG. 4 is an enlarged partial cross-sectional view of the ground electrode taken along line Y-Y in FIG. 3.

FIG. 3 is an enlarged partial cross-sectional view of the ground electrode 30 taken along line X-X in FIG. 2. FIG. 4 is an enlarged partial cross-sectional view of the ground electrode 30 taken along line Y-Y in FIG. 3. The X-X cross section is a plane which passes through the center axis of the center electrode 20 and is perpendicular to a direction in which the ground electrode 30 projects from the metallic shell 50 toward the center electrode 20 (a horizontal direction in FIG. 2). The Y-Y cross section is a plane which passes through the center axis of the center electrode 20 and is approximately parallel to the direction in which the ground electrode 30 projects from the metallic shell 50 toward the center electrode 20.

The ground electrode 30 has side end surfaces 34 and 35 (FIG. 3) in addition to the front end surface 31, the opposing surface 32, and the back surface 33. The side end surfaces 34 and 35 of the ground electrode 30 are surfaces which intersect the front end surface 31, the opposing surface 32, and the back surface 33 shown in FIG. 2 and which constitute side ends of the ground electrode 30. In the present embodiment, the distance between the opposing surface 32 and the back surface 33; i.e., the thickness T (FIG. 3) of the ground electrode 30, is 1.5 mm; and the distance between the side end surface 34 and the side end surface 35; i.e., the electrode width W of the ground electrode 30, is 2.8 mm.

As shown in FIGS. 3 and 4, the press-formed recess portion 37 of the ground electrode 30 includes a side surface 372 and a pin-contacted bottom surface 376, with which a working pin (to be described later) has come into contact. The side surface 372 has a pin-contacted side surface 374, with which the working pin has come into contact, and a pin-uncontacted side surface 378, with which the working pin has not come into contact. That is, the press-formed recess portion 37 has a first space portion 37*a* having an approximately truncated conical shape and surrounded by the pin-contacted side surface 374, and a second space portion 37*b* having an approximately truncated conical shape and surrounded by the pin-uncontacted side surface 378. Moreover, within the press-formed recess portion 37, there is formed a boundary plane 379 including the boundary between the pin-contacted side surface 374 and the pin-uncontacted side surface 378. In the present embodiment, the boundary plane 379 is parallel to the pin-contacted bottom surface 376. Notably, in the case where the boundary between the pin-contacted side surface 374 and the pin-uncontacted side surface 378 is not present in a single plane parallel to the pin-contacted bottom surface 376, of planes parallel to the pin-contacted bottom surface 376, a plane which includes the boundary to the greatest extent is specified, and a region of the specified plane surrounded by the side surface 372 is considered the boundary plane 379. The pin-contacted bottom surface 376 of the press-formed recess portion 37 is a surface which is approximately parallel to the back surface 33 and which constitutes the bottom of the press-formed recess portion 37. The pin-contacted side surface 374 of the press-formed recess portion 37 is a surface which extends approximately along a direction in which the press-formed recess portion 37 extends from the back surface 33 toward the opposing surface 32; i.e., toward the center electrode 20. The pin-uncontacted side surface 378 is a curved surface formed between the back surface 33 and the pin-contacted side surface 374. When the depth of a portion formed by the pin-uncontacted side surface 378 (i.e., the second portion 37*b*) is represented by B1 and the depth of the press-formed recess portion 37 is presented by B2, preferably, a relation $B1/B2 \geqq 0.05$ is satisfied. The reason for employing such a ratio between the depth B1 and the depth B2 will be described later.

Depending on the shape of the working pin and press conditions, the pin-contacted side surface 374 may become perpendicular to the back surface 33 of the ground electrode 30 and the pin-contacted bottom surface 376 of the press-formed recess portion 37 or may incline in relation to these surfaces to some degree. In the present embodiment, the pin-contacted side surface 374 is tapered such that the diameter of the press-formed recess portion 37 increases from the pin-contacted bottom surface 376 toward the back surface 33. Such a shape of the press-formed recess portion 37 is formed as a result of the ground electrode 30 being pressed by use of a working pin whose diameter decreases toward its tip end. When the diameter of the press-formed recess portion 37, as measured at the boundary between the pin-contacted side surface 374 and the pin-uncontacted side surface 378 (i.e., the diameter of the boundary plane 379), is represented by $\phi C$ and the diameter of the pin-contacted bottom surface 376 of the press-formed recess portion 37 is represented by $\phi D$, preferably, a relation $-0.1\ \text{mm} \leqq \phi C - \phi D \leqq 0.4\ \text{mm}$ is satisfied. The reason for employing such a difference between the diameters $\phi C$ and $\phi D$ will be described later. A shape which makes the difference ($\phi C - \phi D$) negative is formed in the case where, when a working pin 640 is withdrawn from the ground electrode 30 after formation of the projecting portion 36, the pin-contacted side surface 374 of the press-formed recess portion 37 deforms on the side toward the back surface 33.

Moreover, when the area of the boundary plane 379 is represented by C and the area of the pin-contacted bottom surface 376 is represented by D, preferably, a relation $0.83 \leqq (C/D) \leqq 1.60$ is satisfied. The reason for employing such a ratio between the areas C and D will be described later.

In FIG. 4, a straight line passing through a distal end portion 312 of the ground electrode 30 located on the side toward the center electrode 20 and a distal-end-side root portion 366 (a portion of the root of the projecting portion 36 located on the side toward the distal end of the ground electrode 30) is represented by E1; and a straight line passing through the distal-end-side root portion 366 and a proximal-end-side root portion 368 (a portion of the root of the projecting portion 36 located on the side toward the proximal end of the ground electrode) is represented by E2. The straight lines E1 and E2 form an angle E (°) therebetween (E is not greater than 90°). That is, a distal-end-side opposing surface 326 (a portion of the opposing surface 32 located on the distal end side of the projecting portion 36) is inclined toward the back surface 33 from a plane passing through the distal-end-side root portion 366 and the proximal-end-side root portion 368 by the angle E. This angle E is formed when the recess portion 37 is formed by means of pressing the ground electrode 30 with the working pin 640. Notably, the distal-end-side opposing surface 326 is not necessarily required to be inclined, and may be parallel to the plane passing through the distal-end-side root portion 366 and the proximal-end-side root portion 368. Preferably, the angle E formed between the straight lines E1 and E2 satisfies a relation $0° \leqq E \leqq 5°$. The reason for employing such an angle E will be described later.

As shown in FIG. 3, the opposing surface 32 of the ground electrode 30 has a flat surface 322 and rounded corner portions 324. The flat surface 322 of the opposing surface 32 is a flat surface extending continuously from the root 364 of the projecting portion 36 to the side end surfaces 34 and 35 of the ground electrode 30. The rounded corner portions 324 of the opposing surface 32 are curved surfaces formed when original rounded corner portions of a member which is to become the ground electrode 30 and does not have the projecting portion 36 are deformed as a result of formation of the projecting portion 36. Preferably, the ratio between the distance (length) F1 of the flat surface 322 extending from the root 364 of the projecting portion 36 to the rounded corner portion 324 of the opposing surface 32 and the distance F2 between the root 364 of the projecting portion 36 and the side end surface 34 (35) satisfies a relation $0.4 \leqq (F1/F2) \leqq 1.0$. The reason for employing such a ratio between the distances F1 and F2 will be described later.

As shown in FIGS. 3 and 4, the projecting portion 36 of the ground electrode 30 has a side surface 362 and root portions 364, 366, and 368. The side surface 362 of the projecting portion 36 is a surface which extends approximately along a direction in which the projecting portion 36 projects from the opposing surface 32; i.e., a direction toward the center electrode 20. The root portions 364, 366, and 368 of the projecting portion 36 are transition portions between the opposing surface 32 and the side surface 362 of the projecting portion 36. In the present embodiment, the side surface 362 of the projecting portion 36 is approximately perpendicular to the opposing surface 32; and the root portions 364 of the projecting portion 36 are formed as corner portions forming substantially right angles. Preferably, a projection amount A of the projecting portion 36 from the opposing surface 32 satisfies a relation $0.4\ \text{mm} \leqq A \leqq 1.0\ \text{mm}$. The reason for employing such a projection amount A will be described later.

Figure 5:
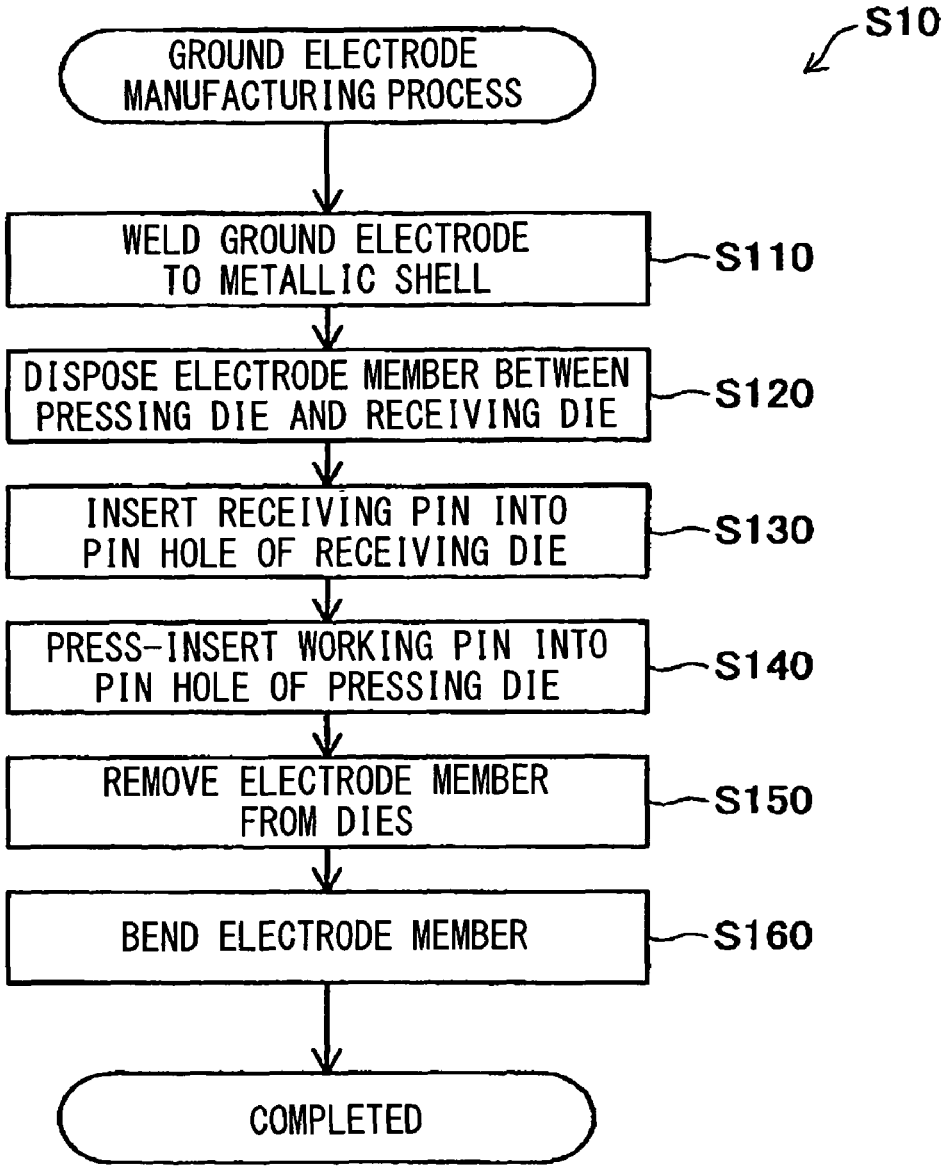
FIG. 5 is a flowchart showing a process of manufacturing the ground electrode.
Figure 6:
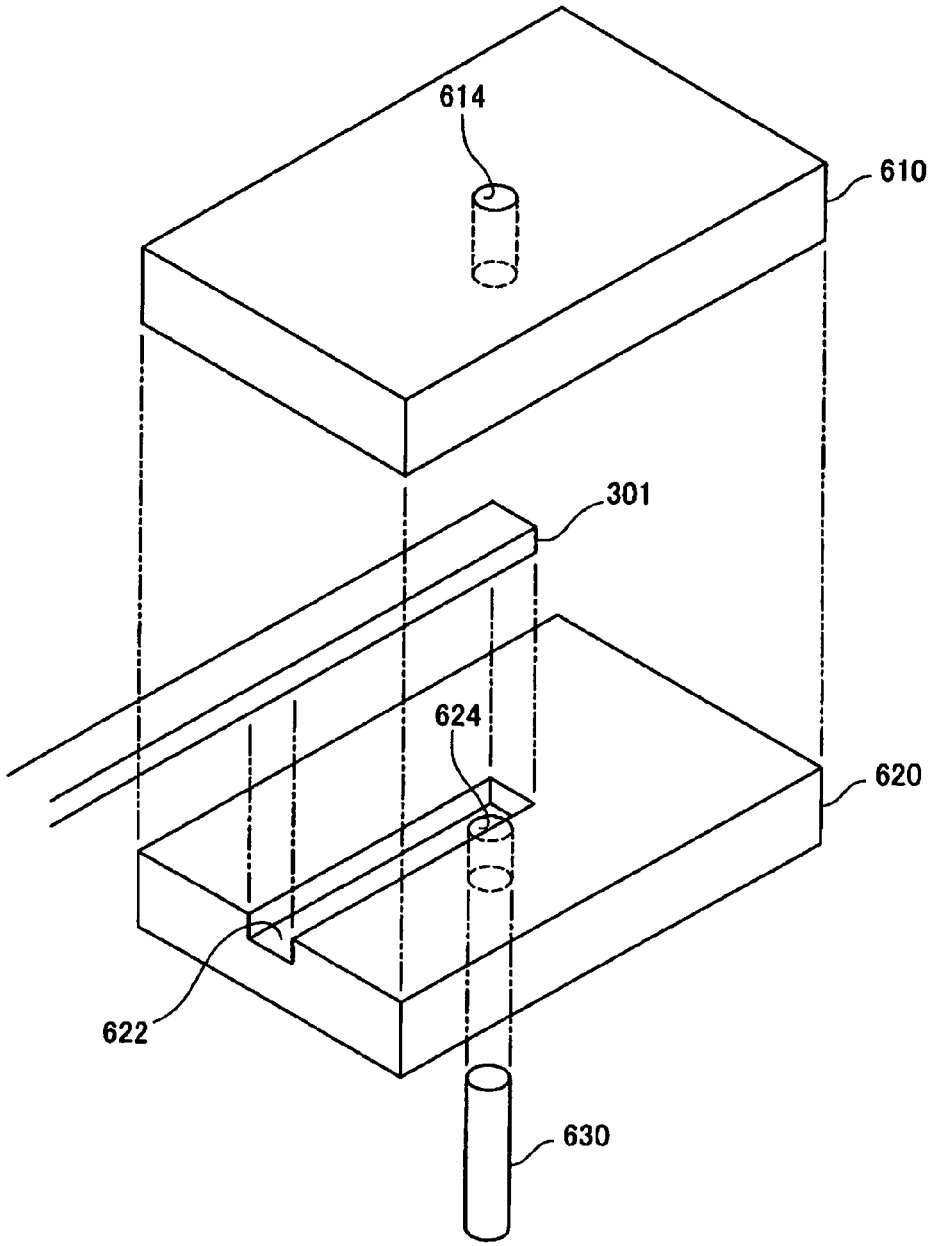
FIG. 6 is an explanatory view showing the manufacture of the ground electrode.
Figure 7:
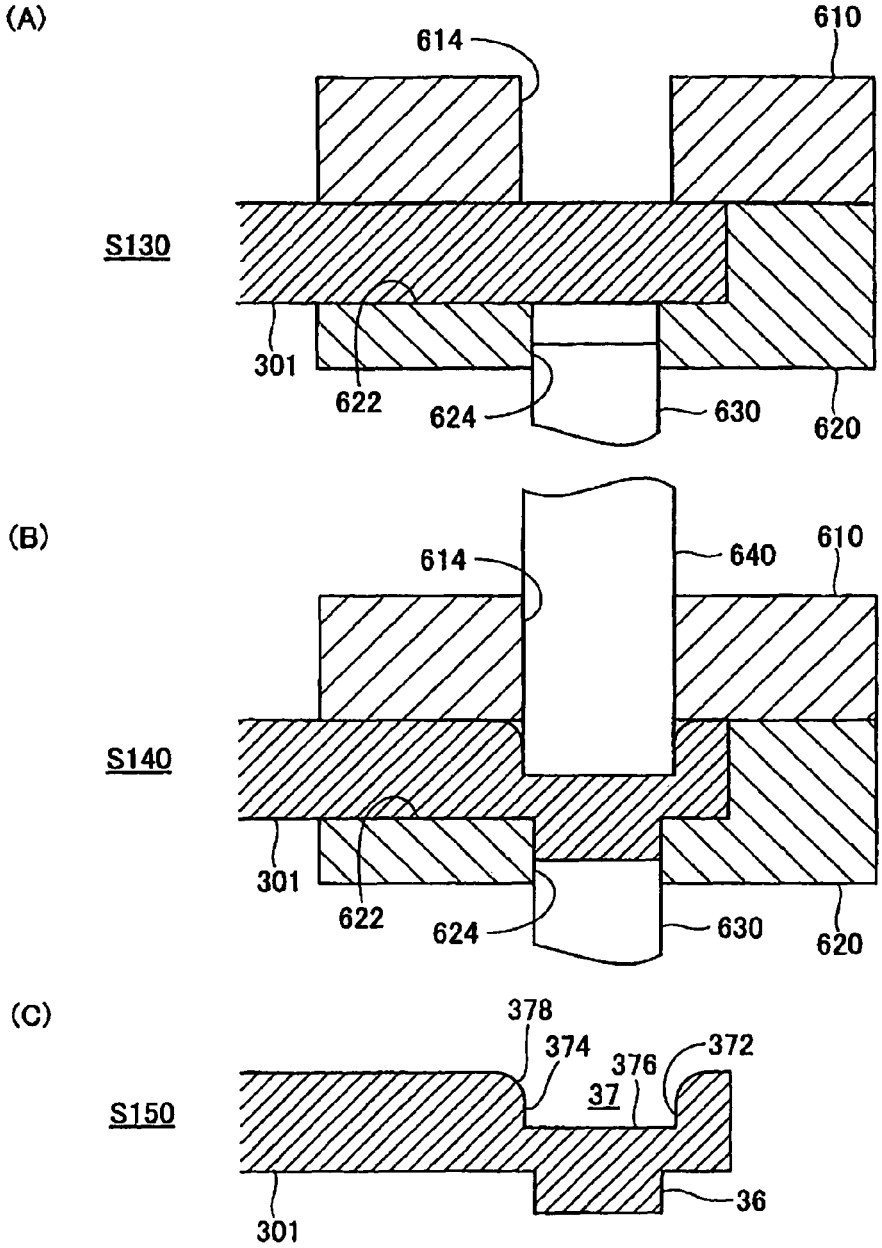
FIG. 7 is an explanatory views showing the manufacture of the ground electrode.

Next, there will be described a process of manufacturing the ground electrode 30, which is a portion of a process of manufacturing the spark plug 100. FIG. 5 is a flowchart showing the process of manufacturing the ground electrode 30. FIGS. 6 and 7 are explanatory views showing the manufacture of the ground electrode 30. First, an electrode member 301, which is a material of the ground electrode 30, is prepared (step S110). In the present embodiment, the electrode member 301 is a rod-like member formed of a nickel alloy and having an approximately rectangular cross section.

After the preparation of the electrode member 301 (step S110), the electrode member 301 is disposed between a holding die 610 and a receiving die 620 (step S120). The holding die 610 and the receiving die 620 are those used for half punching. As shown in FIG. 6, the receiving die 620 has a forming groove 622 having a shape approximately the same as that of the electrode member 301. The electrode member 301 is accommodated within the forming groove 622 of the receiving die 620. The holding die 610 has a pin hole 614 formed at a position corresponding to the position of the forming groove 622 of the receiving die 620 and the position of the press-formed recess portion 37 of the ground electrode 30. The receiving die 620 has a pin hole 624 formed at a position corresponding to that of the projecting portion 36 of the ground electrode 30.

After placement of the electrode member 301 between the holding die 610 and the receiving die 620 (step S120, FIG. 7(A)), a receiving pin 630 is inserted into the pin hole 624 of the receiving die 620 (step S130). The receiving pin 630 has a diameter approximately equal to that of the pin hole 624 of the receiving die 620, and, through adjustment of the insertion amount by which the receiving pin 630 is inserted into the pin hole 624, the projection amount A of the projecting portion 36 can be adjusted.

After the receiving pin 630 is inserted into the pin hole 624 (step S130), the working pin 640 is press-inserted into the pin hole 614 of the holding die 610, whereby half punching is performed on the electrode member 301 (step S140). As shown in FIG. 7(B), when the working pin 640 is press-inserted into the pin hole 614, a portion of the electrode member 301 adjacent to the pin hole 614 of the holding die 610 is pushed and depressed by the working pin 640 and forms the recess portion (press-formed recess portion) 37; and a portion of the electrode member 301 adjacent to the pin hole 624 of the receiving die 620 is pushed by the working pin 640 into the pin hole 624, and forms the projecting portion 36.

When the press-formed recess portion 37 is formed as a result of the relevant portion of the electrode member 301 being pushed and depressed by the working pin 640, a surface of the electrode member 301 located in the vicinity of the circumference of the working pin 640 is pulled in the press direction of the working pin 640 (downward in FIG. 7(B)). As a result, the side surface 372 of the press-formed recess portion 37 is formed so that it has the pin-contacted side surface 374 with which the working pin 640 has come into contact, and the pin-uncontacted side surface 378 with which the working pin 640 has not come into contact (FIG. 7(C)).

After the electrode member 301 is processed through half punching (step S140), the electrode member 301 having the projecting portion 36 and the press-formed recess portion 37 is removed from the dies (step S150). Subsequently, the electrode member 301 removed from the dies is bent (step S160), whereby the ground electrode 30 is completed.

In the present embodiment, the ground electrode 30 is manufactured by means of performing half punching and bending on the electrode member 301 welded to the metallic shell 50 in advance. However, in other embodiments, the ground electrode 30 may be manufactured by means of performing half punching and bending on the electrode member 301 before being welded to the metallic shell 50. Alternatively, the bending work may be performed after the electrode member 301 having undergone half punching is welded to the metallic shell 50.

B. Experiment Results

Figure 8:
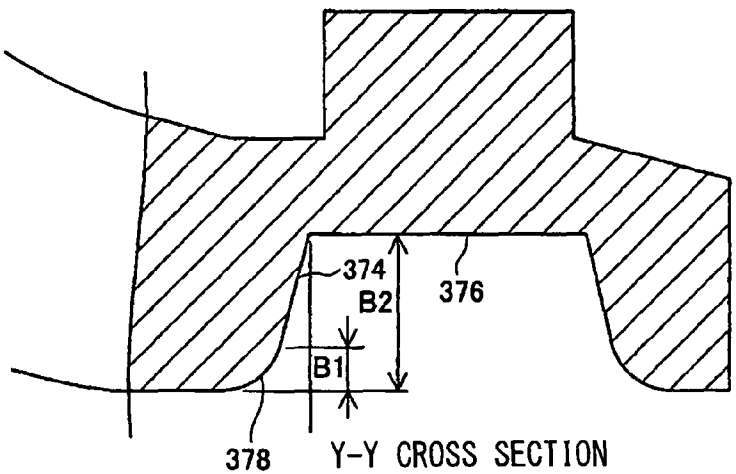
FIG. 8 illustrates a table and explanatory view showing results of a first evaluation experiment in which influence of a ratio (B1/B2) on formability was investigated.

FIG. 8 includes an explanatory table and an explanatory view showing results of a first evaluation experiment in which influence of the ratio (B1/B2) on formability was investigated. FIG. 8 shows various values of the ratio (B1/B2) and biting occurrence rate at each of the various values. As mentioned above, the ratio (B1/B2) is the ratio of the depth B1 of the second portion, with which the working pin 640 has not come into contact, to the depth B2 of the press-formed recess portion 37. The biting occurrence rate is a rate at which the working pin 640 bites against the ground electrode 30 when it is pressed with the working pin 640. In the evaluation experiment associated with FIG. 8, the thickness T of the ground electrode 30 was set to 1.5 mm, the electrode width W of the ground electrode 30 was set to 2.8 mm, the projection amount A of the projecting portion 36 was set to 0.7 mm, the diameter of the projecting portion 36 was set to 1.5 mm, the depth of the press-formed recess portion 37 was set to 0.7 mm, the diameter of the pin-contacted bottom surface 376 of the press-formed recess portion 37 was set to 1.7 mm, and the difference (ϕC−ϕD) between the diameters ϕC and ϕD was set to 0 mm. Furthermore, the pressing speed of the working pin 640 was set to 0.5 mm/sec when the ratio (B1/B2) was 0.1, and the ratio (B1/B2) was changed by means of changing the pressing speed. In the evaluation experiment associated with FIG. 8, half punching was performed on electrode members by use of the working pin 640 so as to produce a plurality of ground electrodes 30 having different values of the ratio (B1/B2), and the ratio at which the working pin 640 bit against the ground electrode 30 was obtained. The occurrence of biting was judged by determining whether or not, after half punching, the working pin 640 could be readily removed from the ground electrode 30 by hand. When the working pin 640 was not readily removed, biting was determined to have occurred.

The experiment results shown in FIG. 8 reveal that, when the ratio (B1/B2) (which represents the ratio of the depth B1 of the second portion, with which the working pin 640 has not come into contact, to the depth B2 of the press-formed recess portion 37) becomes 0.05 or greater, the biting occurrence ratio decreases sharply. Accordingly, it is preferred that the ratio (B1/B2) satisfies the relation (B1/B2)≧0.05.

Figure 9:
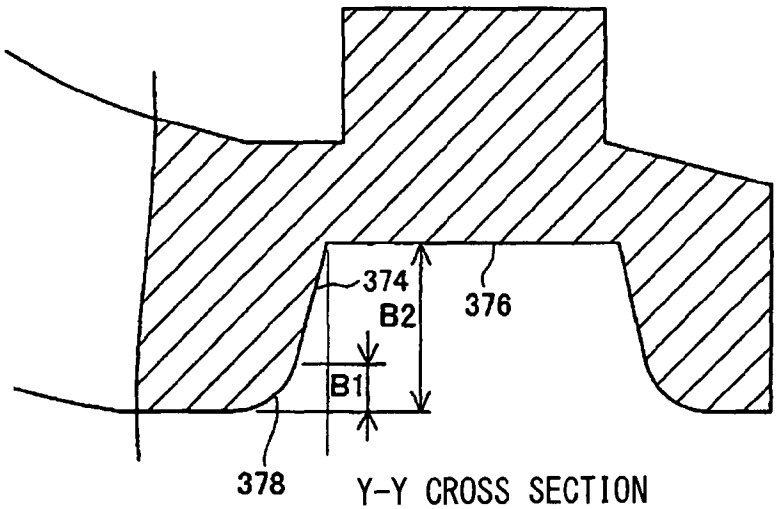
FIG. 9 illustrates a table and explanatory view showing results of a second evaluation experiment in which influence of the ratio (B1/B2) on durability was investigated.

FIG. 9 includes an explanatory table and an explanatory view showing results of a second evaluation experiment in which influence of the ratio (B1/B2) on durability of the ground electrode was investigated. FIG. 9 shows various values of the ratio (B1/B2) and, for each of the values, whether or not a crack was generated in the ground electrode 30 after performance of a hot vibration test. In the evaluation test associated with FIG. 9, there were prepared spark plugs 100 whose ground electrodes 30 differed from each other in terms of the ratio (B1/B2). For the ground electrode 30 whose ratio B1/B2 was 0.02, a ground electrode which did not cause biting of the working pin 640 was used. Other dimensions (thickness T, electrode width W, etc.) of the ground electrodes 30 used in the evaluation experiment associated with FIG. 9 are the same as those used in the first evaluation experiment. The hot vibration test was performed as follows. Each of the prepared spark plugs 100 was attached to a jig, and the ground electrode 30 was heated to 1000° C. by use of a burner. At this temperature, the ground electrode was vibrated for 10 minutes under the condition that acceleration was set to 28 G (G: acceleration of gravity), amplitude was set to 5 mm, and frequency was set to 40 Hz.

Experiment results shown in FIG. 9 reveal that no crack was generated in the ground electrodes 30 in which the ratio (B1/B2) was 0.05 or greater. Meanwhile, a crack(s) was generated in the ground electrode 30 in which the ratio (B1/B2) was 0.02. Accordingly, ground electrodes 30 in which the ratio (B1/B2)≧0.05 can prevent generation of crack, and spark plugs 100 which include the ground electrodes 30 satisfying this condition have improved durability.

Figure 10:
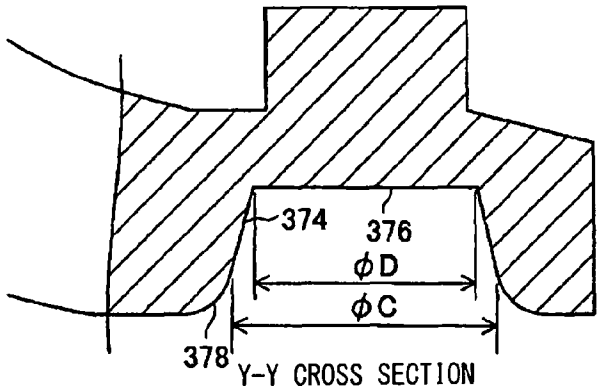
FIG. 10 illustrates a table and explanatory view showing results of an evaluation experiment in which influence of a difference ($\phi C - \phi D$) and a ratio (C/D) on formability was investigated.
Figure 10:
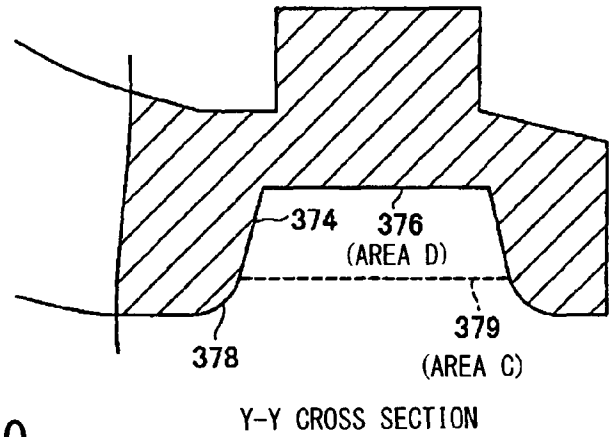

FIG. 10 includes an explanatory table and an explanatory view showing results of an evaluation experiment in which influences of the difference (ϕC−ϕD) and the ratio (C/D) on formability were investigated. FIG. 10 shows various values of the difference (ϕC−ϕD) and a biting occurrence rate and a defective product rate at each of the various values. As described above, the difference (ϕC−ϕD) is the difference between the diameter ϕC of the press-formed recess portion 37 (as measured at the boundary between the pin-contacted side surface 374 and the pin-uncontacted side surface 378) and the diameter ϕD of the pin-contacted bottom surface 376. The biting occurrence rate is a rate at which the working pin 640 bites against the ground electrode 30 when it is pressed with the working pin 640. The defect product rate is a rate at which the projecting portion 36 does not have a target shape. FIG. 10 also shows the area C of the pin-contacted bottom surface 376 and the area D of the boundary plane 379 calculated from the diameter ϕD and the diameter ϕC. In the evaluation experiment associated with FIG. 10, the thickness T of the ground electrode 30 was set to 1.5 mm, the electrode width W of the ground electrode 30 was set to 2.8 mm, a target projection amount A of the projecting portion 36 was set to 0.7 mm, a target diameter of the projecting portion 36 was set to 1.5 mm, the depth of the press-formed recess portion 37 was set to 0.7 mm, the diameter of the pin-contacted bottom surface 376 of the press-formed recess portion 37 was set to 1.7 mm, and the ratio (B1/B2) was set to 0.1. For the case where the difference (ϕC−ϕD) was equal to 0 mm or less, a working pin 640 having a cylindrical columnar shape was used. For the case where the difference (ϕC−ϕD) was greater than 0 mm, a tapered working pin 640 whose diameter decreased toward the distal end thereof was used. In the evaluation experiment associated with FIG. 10, half punching was performed on electrode members by use of the working pin 640 so as to produce a plurality of ground electrodes 30 having different values of the difference (φC−φD), and the ratio at which the working pin 640 bit against the ground electrode 30 was obtained. The occurrence of biting was judged in the same manner as in the evaluation experiment associated with FIG. 8. Moreover, the shape of the projecting portion 36 after half punching was checked so as to determine whether or not the shape coincides with the target shape of the projecting portion 36 (projection amount A: 0.7 mm, diameter: 1.5 mm). When the shape of the projecting portion 36 did not coincide with the target shape of the projecting portion 36, it was determined that a defective product was produced.

Experiment results shown in FIG. 10 demonstrate that the biting occurrence rate decreases sharply when the difference (φC−φD) becomes −0.1 mm or greater, and the defective product rate decreases sharply when the difference (φC−φD) becomes 0.4 mm or less. Accordingly, it is preferred that the difference (φC−φD) satisfies the relation −0.1 mm≦(φC−φD)≦0.4 mm. The experiment results shown in FIG. 10 also reveal that, when the ratio (C/D) is smaller than 0.83 (that is, the area C is smaller than the area D), presumably, a force with which the press-formed recess portion 37 bites against the working pin 640 (that is, a force with which the press-formed recess portion 37 holds the working pin 640) increases, and the biting occurrence rate increases. Meanwhile, when the ratio (C/D) is larger than 1.60 (that is, the area C is larger than the area D), presumably, a force which is applied to the electrode member 301 by the working pin 640 press-inserted with a constant force disperses in the width direction (radius direction), whereby a rate (defective product rate) in which the projecting portion 36 fails to have a target shape increases. Accordingly, it is preferred that the ratio (C/D) satisfies the relation 0.83≦(C/D)≦1.60.

Figure 11:
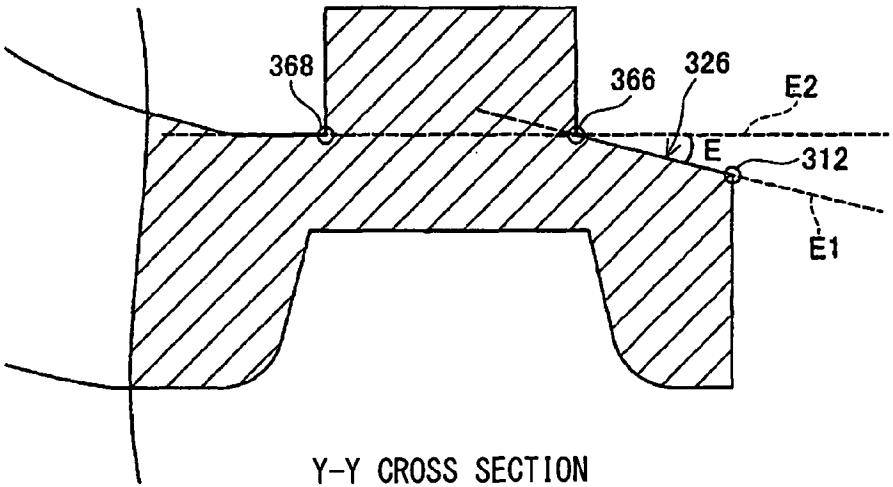
FIG. 11 illustrates a table and explanatory view showing results of an evaluation experiment in which influence of an angle E on formability was investigated.

FIG. 11 includes an explanatory table and an explanatory view showing results of an evaluation experiment in which influence of the angle E on formability was investigated. FIG. 11 shows various values of the angle E and a biting occurrence rate at each of the various values. As described above, the angle E is an angle (not greater than 90°) formed between the straight line E2 passing through the distal-end-side root portion 366 and the proximal-end-side root portion 368 and the straight line E1 passing through the distal-end-side root portion 366 and the distal end portion 312 of the opposing surface 32 located at the distal end of the ground electrode 30. The biting occurrence rate is a rate at which the working pin 640 bites against the ground electrode 30 when it is pressed with the working pin 640. In the evaluation experiment associated with FIG. 11, the thickness T of the ground electrode 30 was set to 1.5 mm, the electrode width W of the ground electrode 30 was set to 2.8 mm, the projection amount A of the projecting portion 36 was set to 0.7 mm, the diameter of the projecting portion 36 was set to 1.5 mm, the depth of the press-formed recess portion 37 was set to 0.7 mm, the diameter of the pin-contacted bottom surface 376 of the press-formed recess portion 37 was set to 1.7 mm, the ratio (B1/B2) was set to 0.1, and the difference (φC−φD) was set to 0 mm. Notably, the occurrence of biting was judged in the same manner as in the evaluation experiment associated with FIG. 8.

Experiment results shown in FIG. 11 reveal that the biting occurrence rate decreases sharply when the angle E becomes 5° or smaller. Accordingly, it is preferred that the angle E satisfies the relation 0°≦E≦5°.

Figure 12:
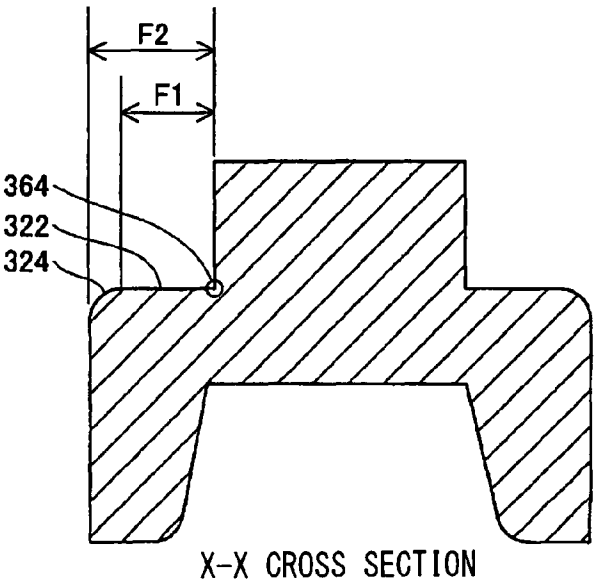
FIG. 12 illustrates a table and explanatory view showing results of an evaluation experiment in which influence of a ratio (F1/F2) on formability was investigated.

FIG. 12 includes an explanatory table and an explanatory view showing results of an evaluation experiment in which influence of the ratio (F1/F2) on formability was investigated. FIG. 12 shows various values of the ratio (F1/F2) and a crack generation rate at each of the various values. As described above, the ratio (F1/F2) is the ratio of the flat surface 322 to the opposing surface 32 of the ground electrode 30. The crack generation rate is the rate at which a crack is generated in the ground electrode 30 when it is stamped with the working pin 640. In the evaluation experiment associated with FIG. 12, the thickness T of the ground electrode 30 was set to 1.5 mm, the electrode width W of the ground electrode 30 was set to 2.8 mm, the depth of the press-formed recess portion 37 was set to 1.0 mm, the diameter of the press-formed recess portion 37 was set to 1.7 mm, the diameter of the projecting portion 36 was set to 1.5 mm, the ratio (B1/B2) was set to 0.1, and the difference (φC−φD) was set to 0 mm. In the evaluation experiment associated with FIG. 12, half punching was performed on electrode members by use of the working pin 640 so as to produce a plurality of ground electrodes 30 having different values of the ratio (F1/F2), and each formed ground electrode 30 was checked so as to determine whether or not a crack was generated in the formed ground electrode 30.

Experiment results shown in FIG. 12 reveal that the crack generation rate increases sharply when the ratio (F1/F2) becomes smaller than 0.4. Accordingly, it is preferred that the ratio (F1/F2) satisfies the relation 0.4≦(F1/F2)≦1.0.

Figure 13:
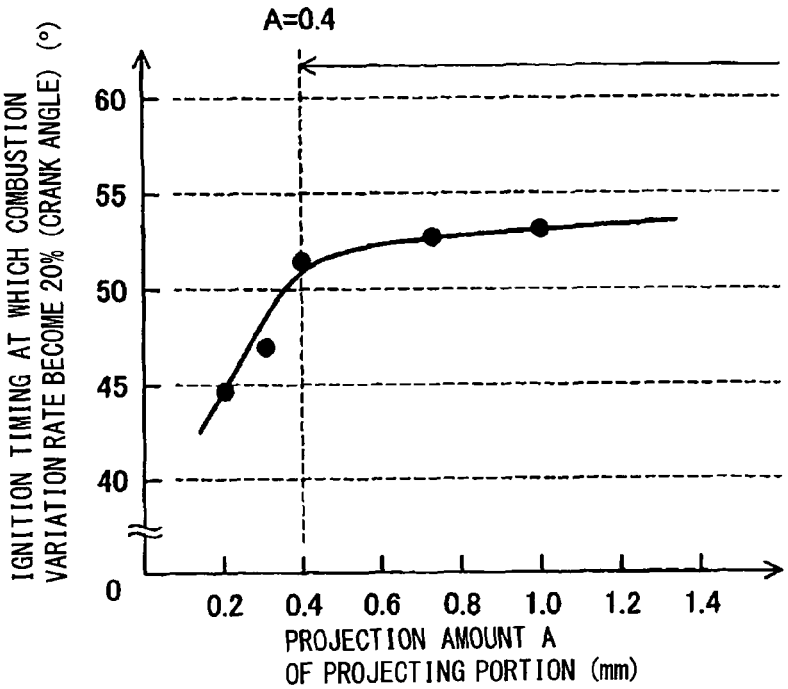
FIG. 13 is an explanatory graph showing results of an evaluation experiment in which influence of a projection amount A on ignition performance was investigated

FIG. 13 is an explanatory graph showing results of an evaluation experiment in which influence of the projection amount A on ignition performance was investigated. FIG. 13 shows the relation between the projection amount A (horizontal axis) and the ignition timing at which combustion variation rate becomes 20% (vertical axis). The combustion variation rate was obtained as follows. An indicated mean effective pressure (IMEP) was obtained from combustion pressure, and the combustion variation rate is obtained from the mean value and standard deviation of 500 samples in accordance with an equation "(the combustion variation rate) =(the standard deviation/the mean value)×100(%)." In FIG. 13, the ignition timing at which the combustion variation rate becomes 20% is indicted by use of crank angle of the internal combustion engine. In the evaluation experiment associated with FIG. 13, a plurality of spark plugs 100 were prepared such that the projecting portion 36 had a diameter of 1.5 mm, and the projection amount A of the projecting portion 36 varied among the spark plugs. These spark plugs 100 were attached to a DOHC-type gasoline engine having a displacement of 2000 cc, and the engine was operated in an idle state (intake pressure: 550 mmHg; engine speed: 750 rpm). Thus, experiment results shown in FIG. 13 were obtained. The experiment results shown in FIG. 13 reveal that the ignition performance deteriorates sharply when the projection amount A becomes smaller than 0.4 mm.

Figure 14:
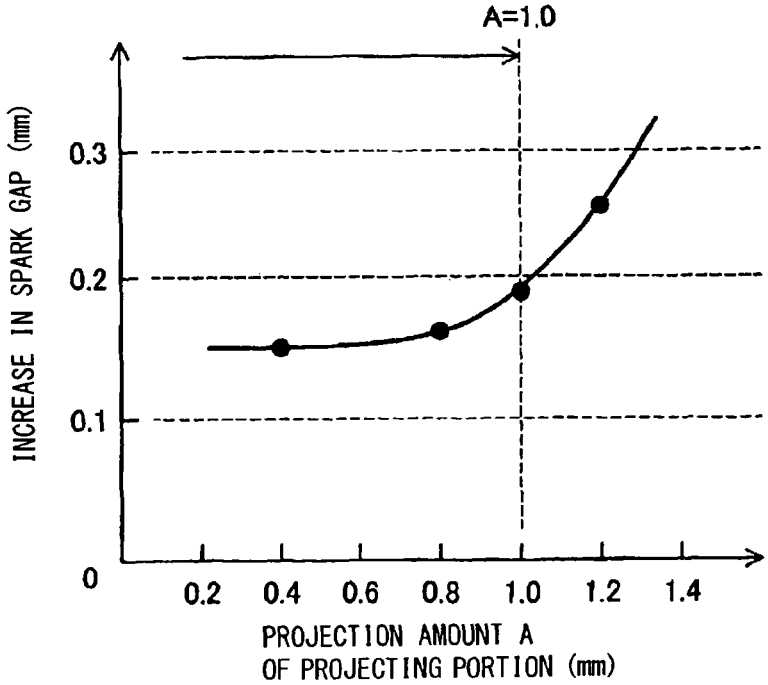
FIG. 14 is an explanatory graph showing results of an evaluation experiment in which influence of the projection amount A on durability was investigated

FIG. 14 is an explanatory graph showing results of an evaluation experiment in which influence of the projection amount A on durability was investigated. FIG. 14 shows the relation between the projection amount A (horizontal axis) and an increase in the spark gap G (vertical axis). In the evaluation experiment associated with FIG. 14, a plurality of spark plugs 100 were prepared such that the projecting portion 36 had a diameter of 1.5 mm, and the projection amount A of the projecting portion 36 varied among the spark plugs. These spark plugs 100 were attached to the DOHC-type gasoline engine having a displacement of 2000 cc, and the engine was operated for 400 hours in a state in which the throttle valve was fully opened (engine speed: 5000 rpm). After that, an increase in the spark gap G was measured. Thus, experiment results shown in FIG. 14 were obtained. The experiment results shown in FIG. 14 reveal that the increase in the spark gap G increases sharply and becomes 0.2 mm (allowable limit) or greater when the projection amount A exceeds 1.0 mm.

Preferably, the projection amount A is not less than 0.4 mm from the view point of ignition performance determined from the results of FIG. 13, and is not greater than 1.0 mm from the view point of durability determined from the results of FIG. 14. That is, it is preferred that the projection amount A satisfies the relation 0.4 mm≦A≦1.0 mm.

In the above, the present invention has been described in detail with reference to its preferred illustrative embodiment. However, the present invention is not limited to the above-described embodiment and configuration. The present invention encompasses various modifications and configurations equivalent to the above-described configuration. Furthermore, various elements of the present invention have been disclosed in various combinations and configurations. However, these are illustrative, and the number of the elements may be greater or smaller than the number of disclosed elements, or may be one. These embodiments fall within the scope of the present invention.

C. Modifications

The present invention is not limited to the above-described embodiment and mode, and may be practiced in various forms without departing from the scope of the invention. For example, the following modifications are possible.

C1. First Through Third Modifications

Figure 15:
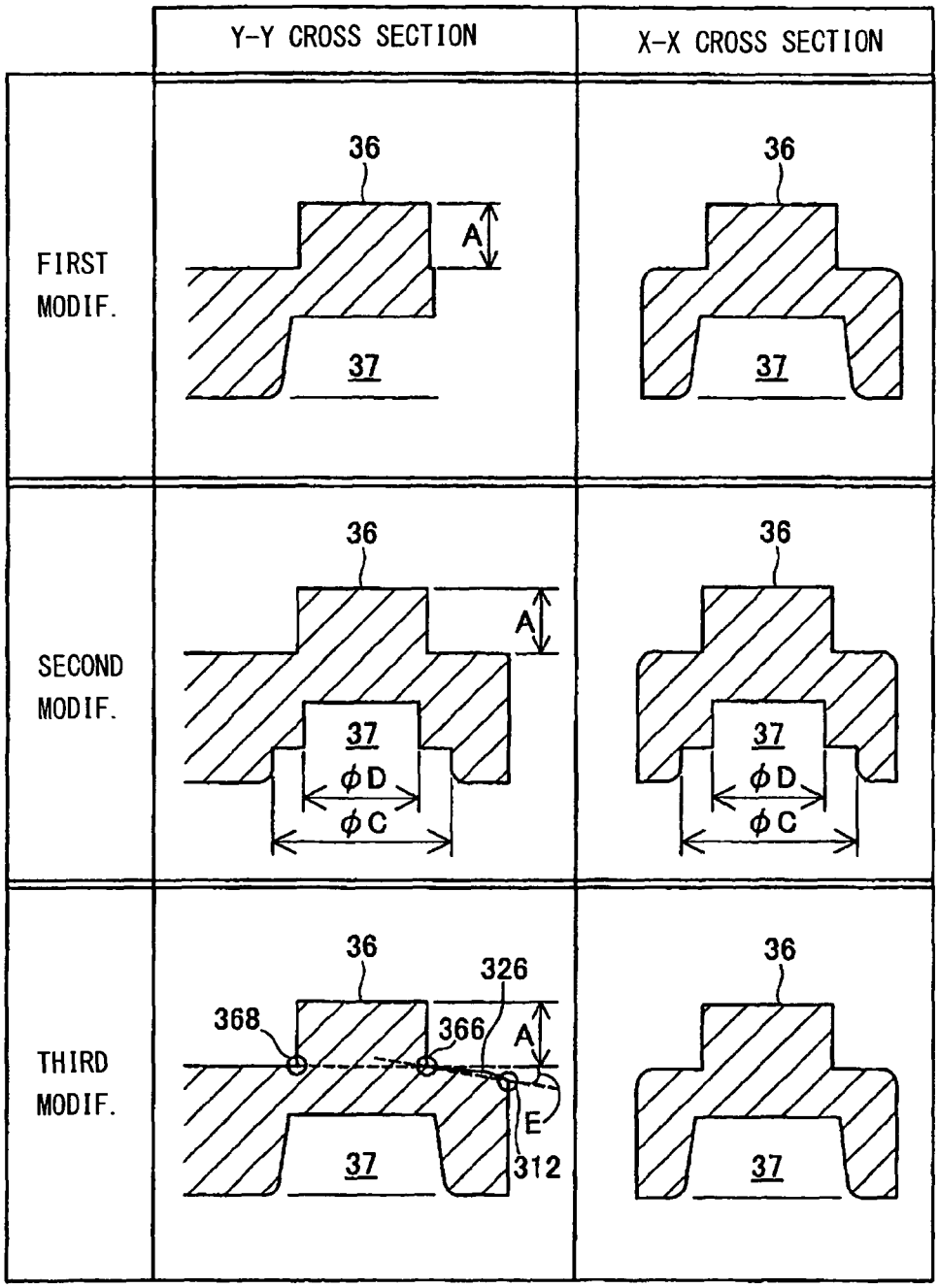
FIG. 15 illustrates explanatory views showing ground electrodes according to first through third modifications.

FIG. 15 is an explanatory view showing ground electrodes 30 according to first through third modifications. In FIG. 15, an X-X cross section corresponding to FIG. 3 and a Y-Y cross section corresponding to FIG. 4 are shown for each of the ground electrodes 30 according to the first through third modifications.

The ground electrode 30 according to the first modification is identical with the above-described embodiment, except that the ground electrode 30 does not have a portion extending from the projecting portion 36 toward the distal end of the ground electrode 30, and the projecting portion 36 is formed at the distal end portion 39 of the ground electrode 30.

The ground electrode 30 according to the second modification is identical with the above-described embodiment, except that the approximately cylindrical columnar shape formed by the pin-contacted side surface 374 of the press-formed recess portion 37 is formed by approximately cylindrical two columnar shapes having different diameters. Such a shape can be formed by means of pressing the ground electrode 30 with a working pin 640 composed of a distal-end-side cylindrical column having a smaller diameter and a proximal-end-side cylindrical column having a larger diameter.

The ground electrode 30 according to the third modification is identical with the above-described embodiment, except that the distal-end-side opposing surface 326 is composed of two different surfaces inclined downward.

C2. Fourth Through Eighth Modifications

Figure 16:
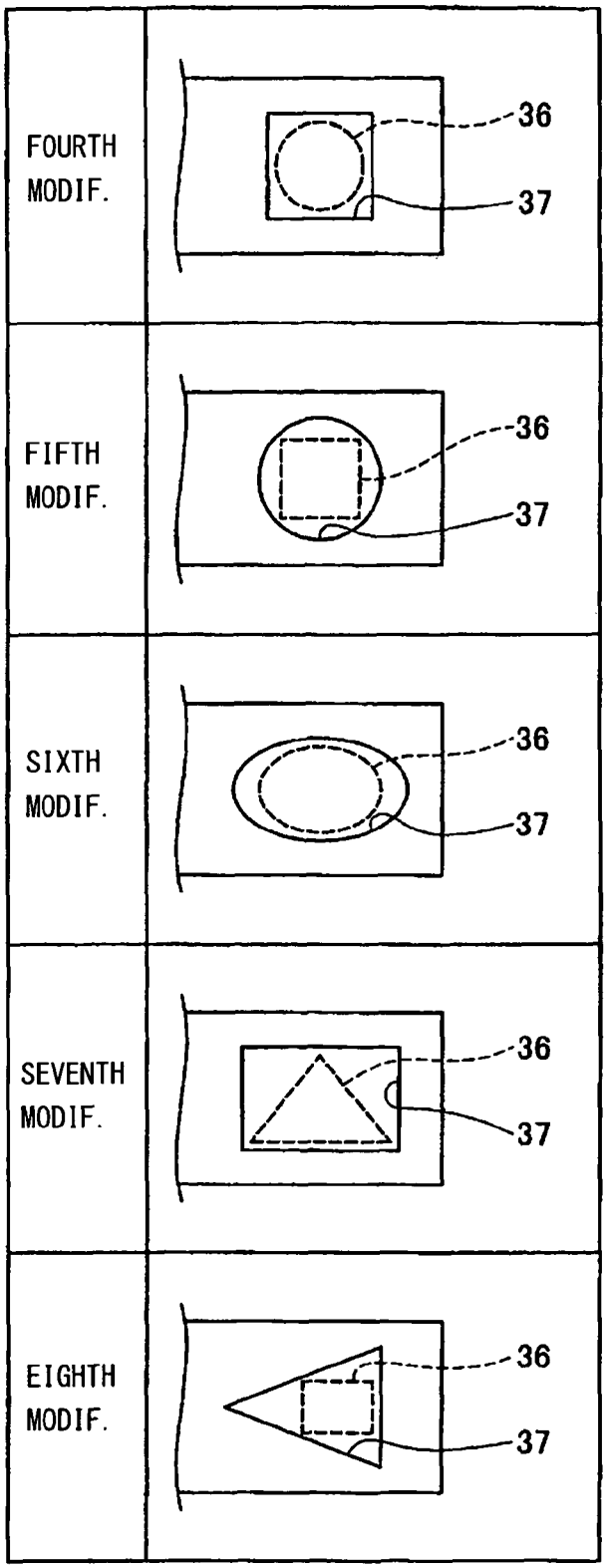
FIG. 16 illustrates explanatory views showing ground electrodes according to fourth through eighth modifications.

FIG. 16 is an explanatory view showing ground electrodes 30 according to fourth through eighth modifications. FIG. 16 show partial enlarged views of the ground electrodes 30 as viewed from the back surface 33 side thereof.

The ground electrode 30 according to the fourth modification is identical with the above-described embodiment, except that, when the ground electrode 30 is viewed from the back surface 33 side, a circular projecting portion 36 is located inside a rectangular press-formed recess portion 37. The ground electrode 30 according to the fifth modification is identical with the above-described embodiment, except that, when the ground electrode 30 is viewed from the back surface 33 side, a rectangular projecting portion 36 is located inside a circular press-formed recess portion 37. The ground electrode 30 according to the sixth modification is identical with the above-described embodiment, except that, when the ground electrode 30 is viewed from the back surface 33 side, an elliptical projecting portion 36 is located inside an elliptical press-formed recess portion 37. The ground electrode 30 according to the seventh modification is identical with the above-described embodiment, except that, when the ground electrode 30 is viewed from the back surface 33 side, a triangular projecting portion 36 is located inside a rectangular press-formed recess portion 37. The ground electrode 30 according to the eighth modification is identical with the above-described embodiment, except that, when the ground electrode 30 is viewed from the back surface 33 side, a rectangular projecting portion 36 is located inside a triangular press-formed recess portion 37. The shapes of the projecting portion 36 and the press-formed recess portion 37 of the ground electrode 30 are not limited to those shown in the embodiment and the fourth through eighth modifications, and each of the projecting portion 36 and the press-formed recess portion 37 may have a polygonal shape or a shape composed of plurality of curves depending on a mode to be employed. These various shapes can be formed by means of forming the pin hole 624 and the receiving pin 630 such that they have cross sectional shapes corresponding to a desired shape of the projecting portion 36, and forming the pin hole 614 and the working pin 640 such that they have cross sectional shapes corresponding to a desired shape of the press-formed recess portion 37.

C3. Ninth Modification

In the above-described embodiment, the ratio (B1/B2) of the press-formed recess portion 37 is changed by means of changing the pressing speed of the working pin 640. However, the ratio (B1/B2) of the press-formed recess portion 37 may be changed by means of changing the surface roughness of a surface of the working pin 640, which surface presses the electrode member 301, or by means of changing other press work conditions such as the temperature of the electrode member 301 at the time of half punching.

C4. Tenth Modification

The spark plug according to the application example 1 may be configured such that the press-formed recess portion has an approximately cylindrical columnar shape, and a relation −0.1 mm≦ϕC−ϕD≦0.4 mm is satisfied, where ϕC represents the diameter of an approximately circular boundary plane between the first and second portions of the press-formed recess portion, and ϕD represents the diameter of the bottom surface of the press-formed recess portion.

In this case as well, biting of the working pin against the ground electrode can be mitigated, and, at the same time, the projecting portion can be formed to have a desired target shape.

Furthermore, the contents of Japanese Patent Application No. 2008-267884 are incorporated herein by reference.

DESCRIPTION OF REFERENCE NUMERALS

3: ceramic resistor
4: seal member
5: gasket
10: insulator
12: axial hole
13: leg portion
17: front trunk portion
18: rear trunk portion
19: flange portion
20: center electrode
21: electrode base material
25: core material

30: ground electrode
31: distal end surface
32: opposing surface
33: back surface
34: side end surface
35: side end surface
36: projecting portion
37: press-formed recess portion
37*a*: first space portion
37*b*: second space portion
38: joint portion
39: distal end portion
40: metal terminal
50: metallic shell
51: tool engagement portion
52: mount screw portion
54: seal portion
57: front end surface
100: spark plug
200: engine head
201: threaded mounting hole
301: electrode member
312: distal end portion
322: flat surface
324: rounded corner portion
326: distal-end-side opposing surface
362: side surface
364: root portion
366: distal-end-side root portion
368: proximal-end-side root portion
372: side surface
374: pin-contacted side surface
376: pin-contacted bottom surface
378: pin-uncontacted side surface
379: boundary plane
610: holding die
614: pin hole
620: receiving die
622: forming groove
624: pin hole
630: receiving pin
640: working pin Having described the invention, the following is claimed:

1. A spark plug comprising:

a rod-shaped center electrode;

an insulator which holds the outer circumference of the center electrode;

a metallic shell which holds the outer circumference of the insulator; and a ground electrode joined to the metallic shell and forming a spark gap between the ground electrode and the center electrode, the ground electrode having a projecting portion which is formed through half punching performed by use of a working pin and which faces the center electrode, and a press-formed recess portion formed on a back surface of the projecting portion as a result of formation of the projecting portion through the half punching, wherein the press-formed recess portion is comprised of a first portion with which the working pin has come into contact, and a second portion with which the working pin has not come into contact; and a relation B1/B2≧0.05 is satisfied, where B1 represents a depth of the second portion, and B2 represents a depth of the press-formed recess portion.

2. A spark plug according to claim 1, wherein a relation 0.83≦C/D≦1.60 is satisfied, where C represents an area of a boundary plane, which is a surface selected from surfaces parallel to a bottom surface of the press-formed recess portion and surrounded by the side surface of the press-formed recess portion, the selected surface containing the boundary between the first portion and the second portion to the greatest extent; and D represents an area of the bottom surface of the press-formed recess portion.

3. A spark plug according to claim 1, wherein the ground electrode has, at its one end, a joint portion joined to the metallic shell, and, at its other end, a distal end portion having a distal end surface;

the distal end surface is approximately parallel to an axial direction of the center electrode; and as viewed on a cross section of the ground electrode parallel to the axial direction of the center electrode, passing through the centroid of the projecting portion, and perpendicular to the distal end surface, an angle E which satisfies a relation 0°≦E≦5° is formed between a straight line E1 and a straight line E2, the straight line E1 passing through a distal end portion of the ground electrode on the side facing the center electrode and a distal-end-side root portion of the ground electrode, which is a portion of a root of the projecting portion located on the side toward the distal end of the ground electrode, and the straight line E2 passing through the distal-end-side root portion and a proximal-end-side root portion of the ground electrode, which is a portion of the root of the projecting portion located on the side toward the proximal end of the ground electrode.

4. A spark plug according to claim 1, wherein a ratio F1/F2 satisfies a relation 0.4≦F1/F2≦1, where F1 represents a length of a flat surface extending from the root of the projecting portion to a side end of the ground electrode, and F2 represents a distance between the root and the side end of the ground electrode.

5. A spark plug according to claim 1, wherein the projecting portion has a height A which satisfies a relation 0.4 mm≦A≦1.0 mm.

6. A method of manufacturing a spark plug comprising: a rod-shaped center electrode; an insulator which holds the outer circumference of the center electrode; a metallic shell which holds the outer circumference of the insulator; and a ground electrode joined to the metallic shell and forming a spark gap between the ground electrode and the center electrode, the method comprising:

forming on the ground electrode a projecting portion which faces the center electrode through half punching performed by use of a working pin, wherein a press-formed recess portion is formed on a back surface of the projecting portion, as a result of formation of the projecting portion through the half punching, so that the press-formed recess portion is comprised of a first portion with which the working pin has come into contact, and a second portion with which the working pin has not come into contact, and a relation B1/B2≧0.05 is satisfied, where B1 represents a depth of the second portion, and B2 represents a depth of the press-formed recess portion.

* * * * *